US009865972B2

(12) United States Patent
Smith

(10) Patent No.: US 9,865,972 B2
(45) Date of Patent: Jan. 9, 2018

(54) ELECTRICAL CONNECTOR WITH SPRING CLIP

(71) Applicant: Bridgeport Fittings, Inc., Stratford, CT (US)

(72) Inventor: Lawrence J. Smith, Stamford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 453 days.

(21) Appl. No.: 13/949,209

(22) Filed: Jul. 23, 2013

(65) Prior Publication Data

US 2015/0031231 A1 Jan. 29, 2015

(51) Int. Cl.
*H01R 13/74* (2006.01)
*H01R 24/56* (2011.01)

(52) U.S. Cl.
CPC ..... *H01R 13/743* (2013.01); *H01R 24/564* (2013.01)

(58) Field of Classification Search
CPC ..... H01R 13/743; H01R 24/564
USPC ..... 174/660, 665, 666
See application file for complete search history.

(56) References Cited

U.S. PATENT DOCUMENTS 5,171,164 A 12/1992 O'Neil et al.
5,189,258 A 2/1993 Pratesi
5,266,050 A 11/1993 O'Neil et al.
5,539,152 A 7/1996 Gretz
D380,197 S 6/1997 Garcia et al.
5,731,543 A 3/1998 Jorgensen
6,380,483 B1 * 4/2002 Blake ..... H02G 3/0691 16/2.1
6,444,907 B1 9/2002 Kiely
6,768,057 B2 7/2004 Blake
6,860,758 B1 3/2005 Kiely
6,872,886 B2 3/2005 Kiely
6,957,968 B1 10/2005 Gretz
7,064,272 B2 6/2006 Auray et al.
7,075,007 B2 7/2006 Auray et al.
7,205,489 B2 4/2007 Auray et al.
7,214,890 B2 5/2007 Kiely et al.
7,390,979 B1 * 6/2008 Johnson ..... H02G 3/0691 16/2.1
7,461,870 B2 12/2008 Blake
7,576,290 B1 8/2009 Korcz
7,824,213 B1 * 11/2010 Korcz ..... H01R 13/5816 174/64
2011/0204619 A1 * 8/2011 Sathyanarayana ... H02G 3/0691 285/139.1
2013/0056263 A1 * 3/2013 Chavan ..... H02G 3/0691 174/660

* cited by examiner

*Primary Examiner* — Dhirubhai R Patel
(74) *Attorney, Agent, or Firm* — John F. Klos; Billion & Armitage

(57) ABSTRACT

A connector assembly including a connector body with a spring clip including a first free end for engaging a side wall of an electrical box upon installation. During insertion of the connector body the first free end is deformed so as to permit further insertion. Once the connector body is fully inserted, the spring clip cooperates with a lug on the connector body to hold the connector assembly onto the electrical box.

18 Claims, 10 Drawing Sheets

ELECTRICAL CONNECTOR WITH SPRING CLIP

TECHNICAL FIELD

The invention is directed to a further advancement in the field of electrical connector assemblies. More specifically, this application relates to an electrical connector assembly having an integral retaining spring for facilitating the connection of the connector assembly and associated cable, wire conductor and the like to an electrical box.

BACKGROUND OF THE INVENTION

Electrical connectors are commonly used for attaching electrical conductors, cables, wires, electrical metal tubing (EMT) or the like to an electric box, e.g. a junction box, outlet box, switch box, fuse box, or other similar type of electric box. Such known electrical connectors are either of a type that are secured to an electric box by a threaded lock nut or by means of a circular snap fit retaining ring of the type disclosed in U.S. Pat. Nos. 6,860,758; 6,444,907; 5,189,258; 5,266,050; and 5,171,164, for example.

So called "snap fit" connectors have been in use for some time, including connectors disclosed in Applicant's U.S. Pat. Nos. 7,064,272; 7,075,007; 7,205,489 and 7,214,890. Such connectors have typically been coupled to the junction box by forcibly inserting one end of the connector into the knock-out hole of a junction box. Such connectors include a circular retaining ring which is deformed during insertion of the connector body into a knock-hole. In the past, a generally linear motion has been used to insert the connector end into the junction box. Using such a straight motion, the connector end is pushed into the knock out hole so as to deform a retaining ring as it passes through the knock-out hole. As the snap-type connectors are constructed of several pieces, the complexity of the connector is increased. A need exists for a simple connector having fewer component parts.

Also known are one-piece electrical cable connectors having integral retaining springs. One such connector is disclosed in U.S. Pat. No. 7,824,213, assigned to Hubbell Incorporated. The connector includes a body having two spaced apart spring arms extending from an end of the body and angled inwardly to engage the cable and couple the cable to the connector. A coupling tab for coupling to the electrical box is provided.

SUMMARY OF THE INVENTION

The present invention provides a connector assembly including a connector body having an integral spring clip. The spring clip functions to retain the connector assembly upon an electrical box. A free end of the spring clip engages the knock-out hole during installation. Additionally, a spring clip panel includes a plurality of spring arms used to retain the cable. Once the connector body is fully seated, the free end of the spring clip cooperates with a lug to secure the connector assembly onto the electrical box.

The present invention is also directed to a method of using a connector assembly, wherein the method includes inserting a nose end of the connector assembly into the knock-out hole with the free end of the spring clip being deflected prior to contact with a side wall of the junction box, then pivoting and further inserting the connector assembly into the junction box to release the free end and lock the connector body in place. As the connector body is pivoted during installation into the junction box, the free end of the spring clip is initially depressed and then released after a hooked portion of the spring clip enters the junction box.

An object of the present invention is to provide an electrical connector with an integral spring clip whereby the connector body is secured to an outlet box through a simple angled insertion and pivoting motion.

Yet another object of the present invention is to provide an electrical connector with an integral spring clip having a free end for cooperating with an edge of a knock-out hole of an outlet box to retain the electrical connector. The spring clip generates a force tending to retain the connector body within the knock-out hole of the electrical box.

The connector assembly of the invention has a body having a spring clip with a free end that latches or hooks to an edge of an opening in the electrical box and at least one curved spring arm that biases against an interior wall of the electrical box. The connector body engages the cable and connects the assembly to the electrical box.

In one embodiment of the invention, the connector assembly provides a spring clip integrally formed with a body and includes inwardly directed arms that engage the outer surface of the cable to retain the cable in the axial passage of the body. The spring clip has a distal end with a coupling hook that engages edge surfaces of the electrical box at a knockout opening.

A further aspect of the invention is to provide a connector assembly with a spring clip having arm members integrally formed with a common panel to engage and grip the cable. The spring arms extend into the body of the connector to grip the cable. The spring clip is biased outwardly to engage the edge of the opening in the electrical box while the position of the spring arms applies an inward biasing force against the cable.

A further aspect of the invention is to provide a connector assembly without the typical annular stop flange for limiting insertion of the fitting into the outlet box opening and for providing electrical continuity or grounding of the fitting to the wall of the electrical box. In one embodiment of the invention a pair of curved springs function to limit insertion of the fitting into the electrical box. The pair of curved springs cooperate with the spring clip to limit insertion of the fitting into the electrical box. The curved springs improve electrical continuity and mechanically secure the connector assembly at the knock-out hole to limit rotation of the connector assembly relative to the electrical box.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
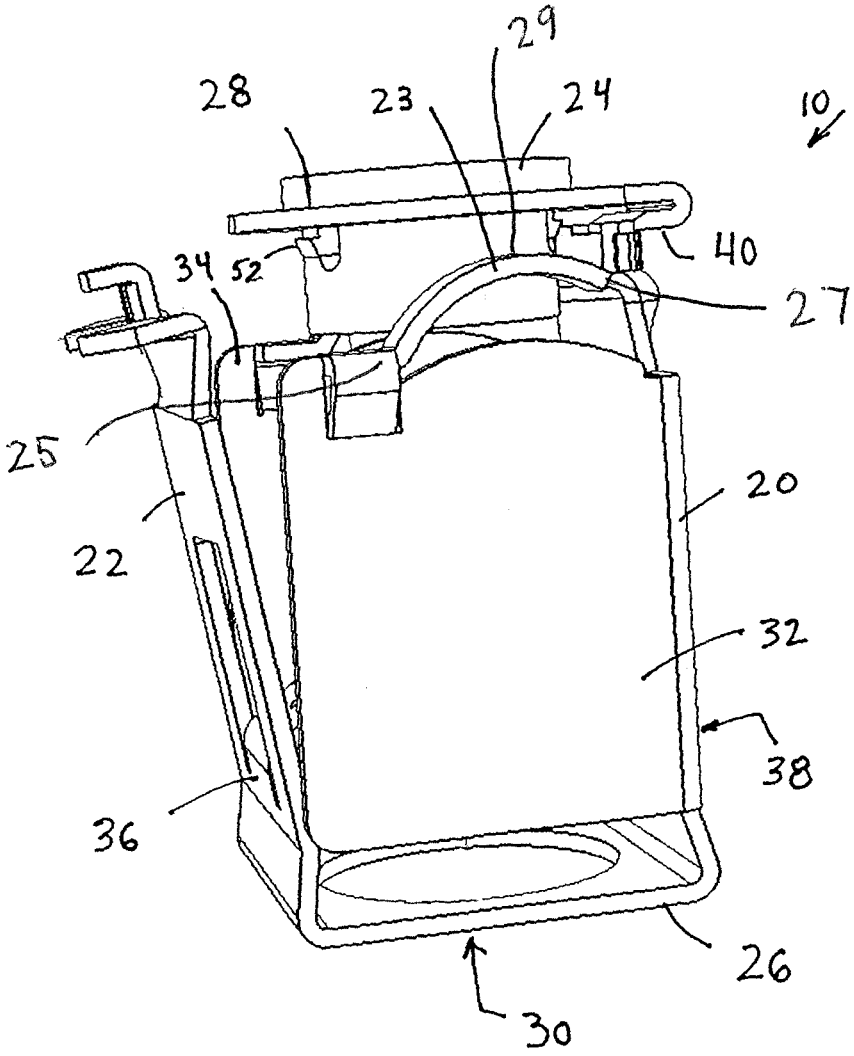
FIG. 1 is a perspective view of an electrical connector assembly in accordance with the present invention.
Figure 2:
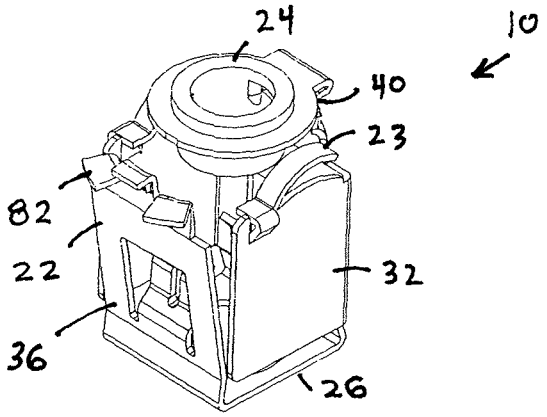
FIG. 2 is a perspective view of the electrical connector assembly of FIG. 1.
Figure 5:
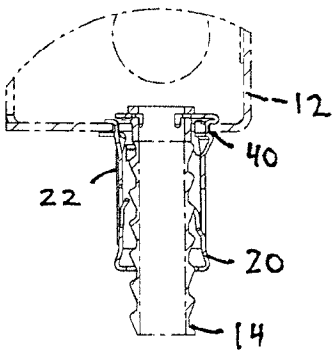
FIG. 5 is a cross-sectional view of the electrical connector assembly of FIG. 4 taken along lines 5-5.
Figure 4:
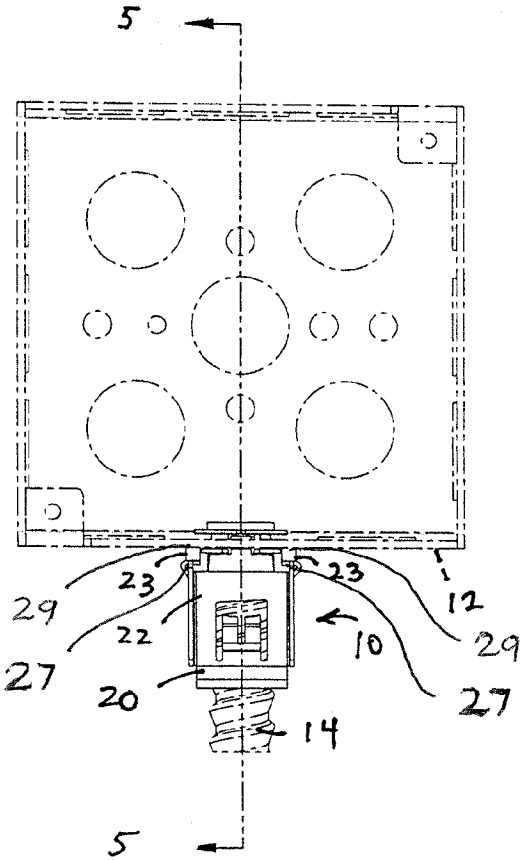
FIG. 4 is a top view of the electrical connector assembly of FIG. 3.
Figure 3:
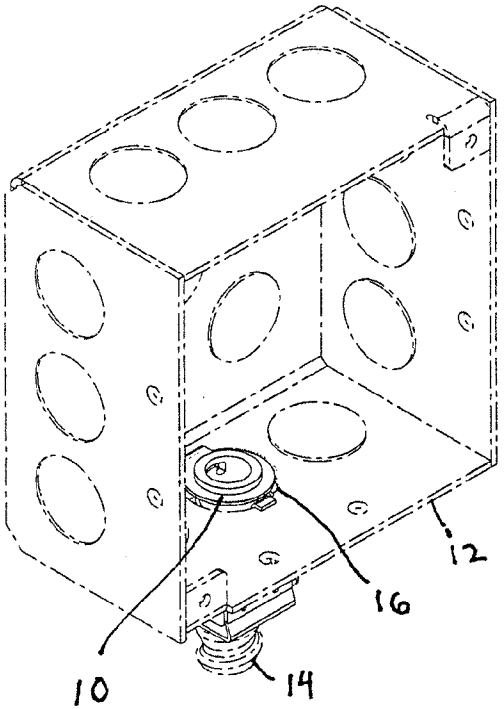
FIG. 3 is a perspective view of the electrical connector assembly of FIG. 1 shown attached to an electrical box.
Figure 9:
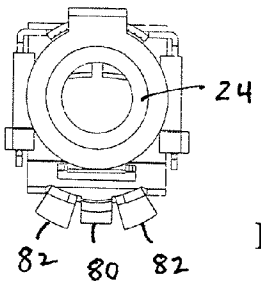
FIGS. 9 and 10 are top views of the connector assembly of FIG. 1.
Figure 8:
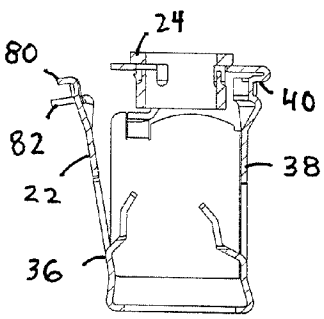
FIG. 8 is a cross-sectional view of the connector assembly of FIG. 1 taken along lines 8-8 of FIG. 7.
Figure 7:
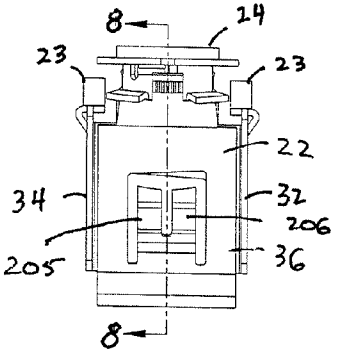
FIG. 7 is a side view of the connector assembly of FIG. 1.
Figure 6:
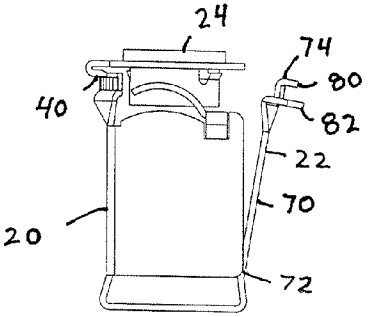
FIG. 6 is a side view of the electrical connector assembly of FIG. 1.
Figure 10:
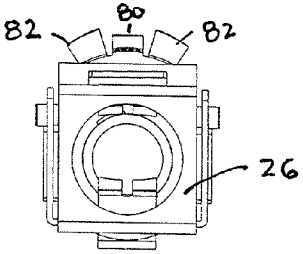
Figure 13:
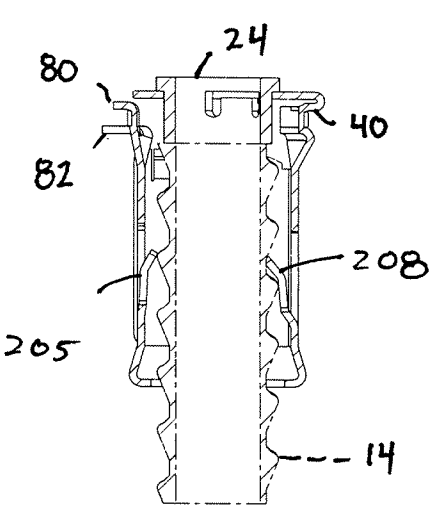
FIG. 13 is a cross-sectional view of the connector assembly of FIG. 12 taken along lines 13-13.
Figure 12:
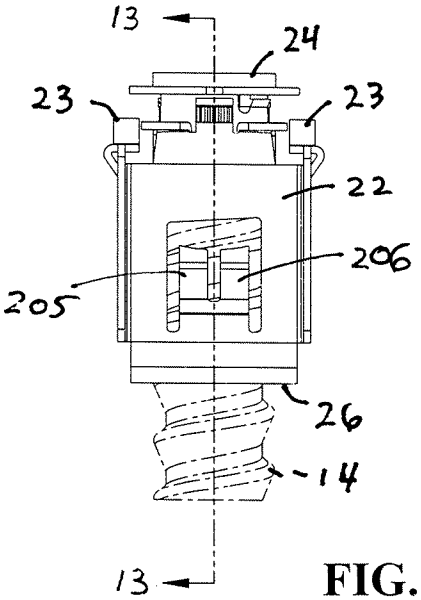
FIG. 12 is a side view of the connector assembly of FIG. 1 shown as connected to a cable.
Figure 11:
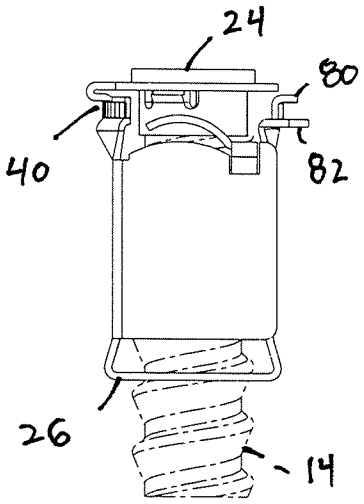
FIG. 11 is a side view of the connector assembly of FIG. 1 shown as connected to a cable.
Figure 14:
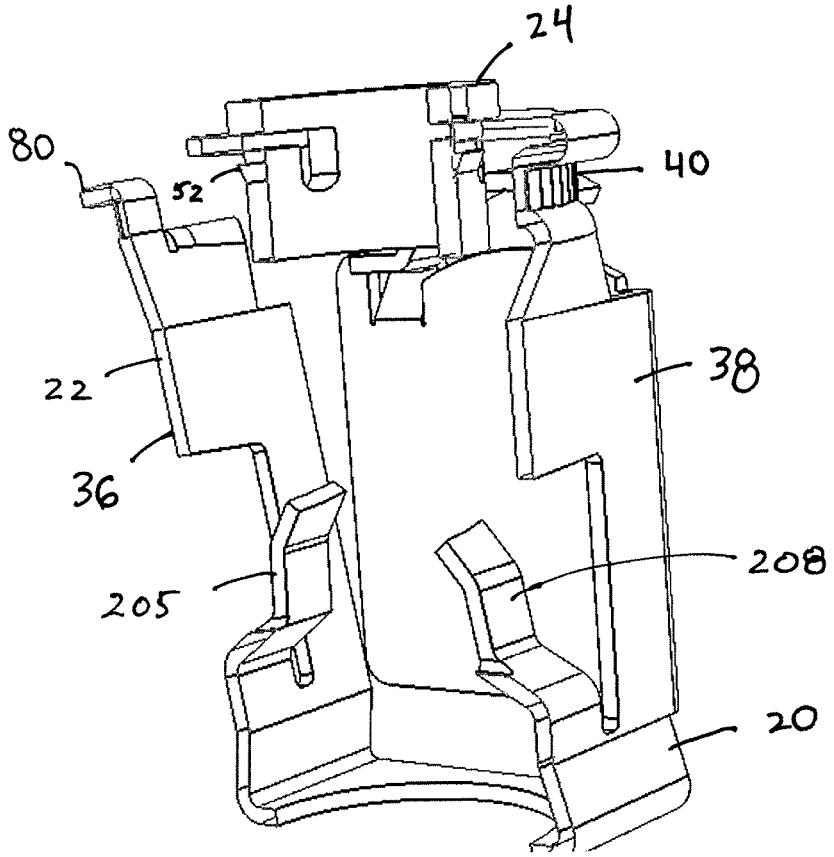
FIGS. 14-16 are cross-sectional views of the connector assembly of FIG. 1.
Figure 15:
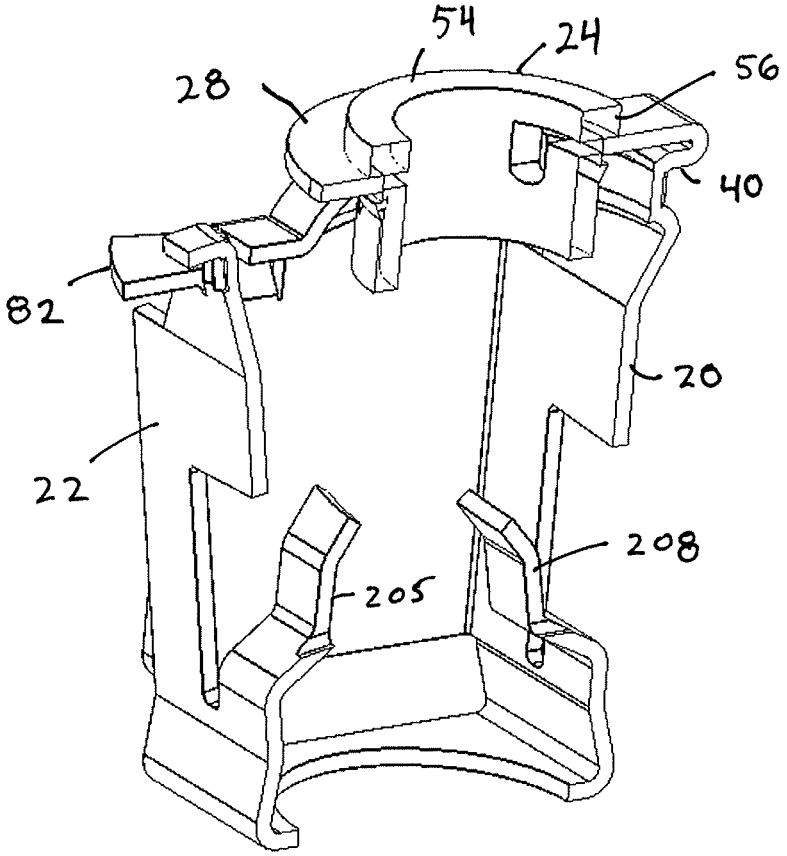
Figure 16:
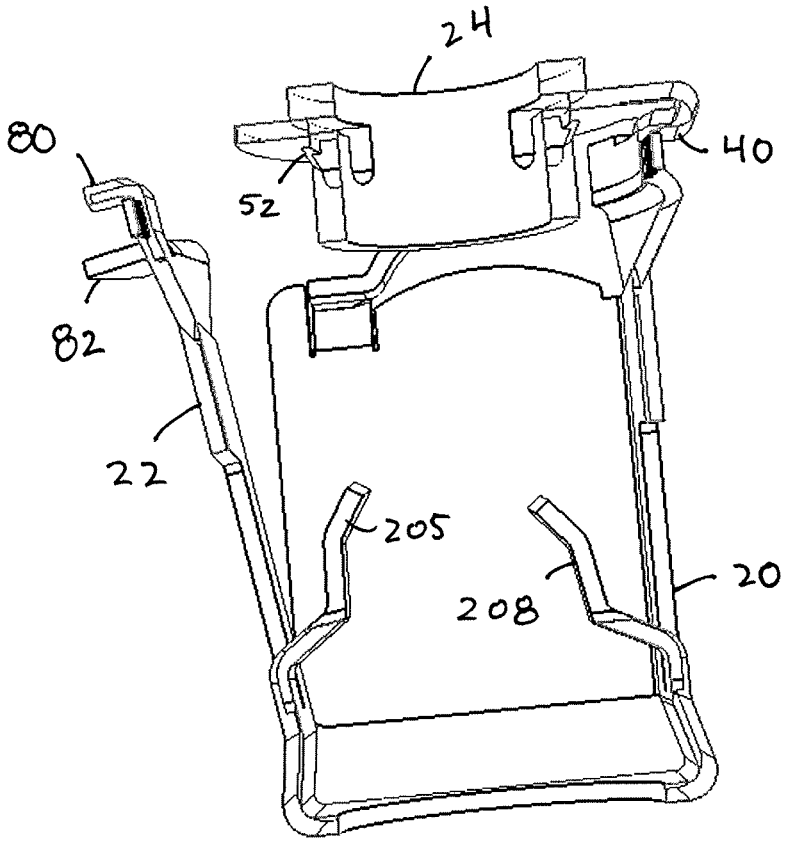
Figure 17:
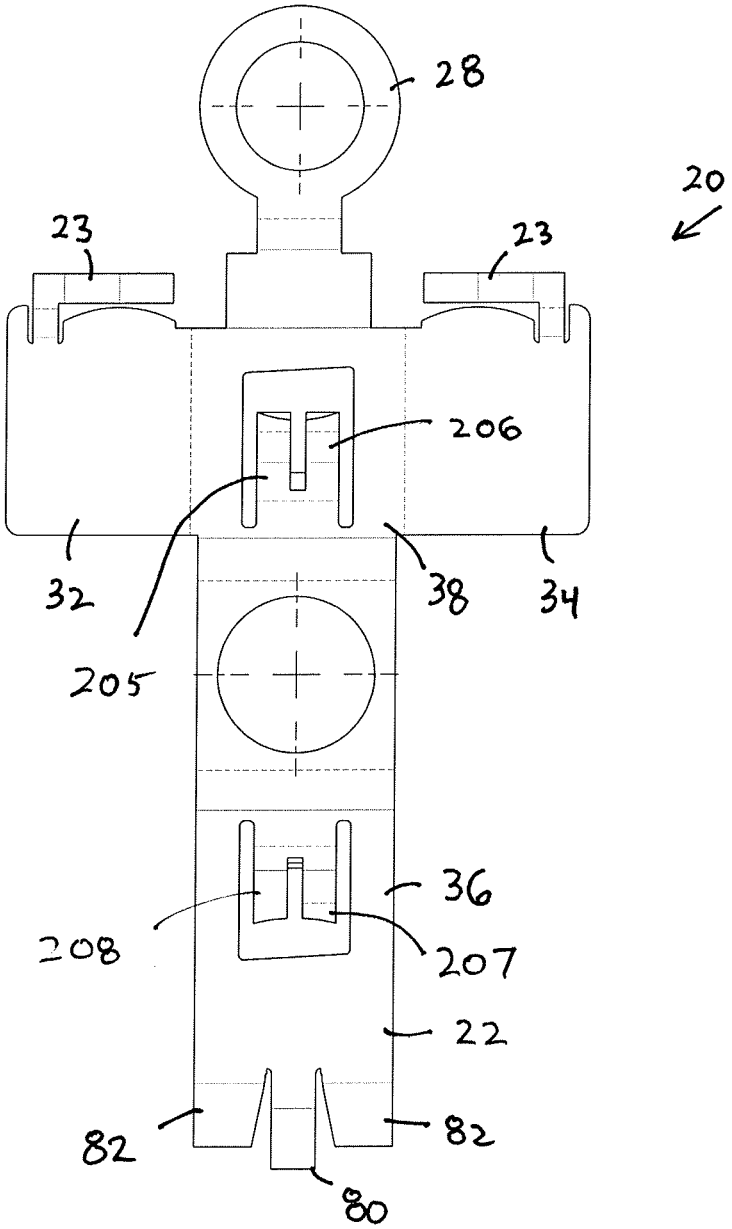
FIG. 17 is a top view of a metal blank used to form the connector body of the connector assembly of FIG. 1.

Referring to the drawings, FIGS. 1 and 2 are perspective views of the first embodiment of an electrical connector assembly 10 in accordance with the present invention. FIGS. 3-5 depict connector assembly 10 between electrical box 12 and electrical cable 14. As described hereinafter, connector assembly 10 is used to couple electrical cable 14 at knock-out hole 16 of electrical box 12. FIGS. 6-10 are additional views of connector assembly 10. FIGS. 11-13 depict connector assembly 10 connected to electrical cable 14. FIGS. 14-16 are cross-sectional views of connector assembly 10. FIG. 17 is a plan view of a metal blank used to form connector body 20.

Referring to FIGS. 1 and 2, connector assembly 10 includes connector body 20 defining a spring clip 22 and curved springs 23, and insulator 24. Connector body 20 is formed with an inlet end portion 26 and an outlet end portion 28 and a bore 30 extending therethrough. Connector body 20 includes a pair of generally parallel sides 32, 34 each carrying one of the curved spring 23 and a pair of sides 36, 38. Spring clip 22 is defined upon side 36.

Intermediate the connector body 20, in the illustrated embodiment between the inlet end portion 26 and outlet end portion 28, there is provided a pair of curved springs 23 which function as stops to limit the degree to which connector body 20 may be inserted through the knock-out hole 16 of electrical box 12. As shown in FIG. 1, each curved spring 23 is connected to connector body 20 at a first end 25. Each curved spring 23 has a second, free end 27 near the outlet end portion 28 that is otherwise unsupported. As shown in FIG. 4, curved springs 23 contact the front face of the electrical box 12 at a contact location 29 upon installation, with the contact location 29 being between the first end 25 and free end 27. Springs 23 function to improve electrical continuity and to mechanically secure the connector assembly 10 at the knock-out hole 16. Springs 23 function to limit rotation of the connector assembly 10 upon installation.

Outlet end portion 28 includes a lug 40 adapted to engage a knock-out hole 16 perimeter during insertion of the connector body 20 into the knock-out hole. As described in more detail hereinafter, lug 40 is part of a positive locking mechanism by which the connector body 20 is secured to electrical box 12.

Insulator 24 is of electrically insulative material and engages a forward opening at the outlet end portion 28 of connector body 20. Insulator 24 is inserted into the generally circular opening in a direction generally parallel to a longitudinal axis of connector body 20. Insulator 24 is prevented from substantial movement along the longitudinal axis of connector body 20 by a pair of locking tabs 52 adapted to engage the underside near the opening (as shown in FIGS. 1, 14 and 16).

Referring to FIG. 15, insulator 24 is inserted into outlet end portion 28 of connector body 20. Insulator 24 has a substantially cylindrical shape with a body which forms a sleeve having an axial passage for receiving electrical wires from electrical cable 14. Insulator 24 has a first end 54 with a collar 56 extending outwardly in a generally radial direction. Collar 56 has a radial dimension sufficient to engage the end of electrical cable 14. Insulator 24 is generally formed from a molded rigid plastic material as a one piece member. As shown in FIGS. 5 and 13, cable 14 is inserted into the bore 30 of the connector body 20. Insertion of cable 14 into the connector body 20 is limited by insulator 24.

Referring to FIGS. 6-10, spring clip 22 includes a central portion 70 positioned between an anchor end 72 and a free end 74. Spring free end 74 includes a hook structure including a hook 80 and a pair of tabs 82. Together the hook 80 and tabs 82 engage surfaces of the electrical box 12 to secure the connector assembly to the box and to provide additional electrical continuity between the connector assembly 10 and the electrical box 12.

The spring clip 22 is preferably constructed of spring steel which has a zinc or other metallic coating like tin, silver or copper, making it highly electrically conductive. Tests have shown that such conductive coatings on spring elements of prior art connector assemblies can reduce contact resistance over 25% as compared to uncoated spring elements. Constructing the connector body 20 of zinc alloy or other corrosion resistant alloys and the spring clip 22 of spring steel enables the connector assembly 10 to establish electrical continuity between the metallic-sheathed cable or conduit and the panel or electrical box to which it is attached.

Referring to FIGS. 14-17, a plurality of cable retaining spring arm members 205, 206, 207, 208 are provided on connector body 20. Side 36 of connector body 20 includes a pair of cable retaining spring arm members 205, 206 functioning to engage and secure the electrical cable 14. Arm members 205, 206 extend from side 36 at an incline in a generally forward direction (toward outlet end portion 28). Side 38 of connector body 20 also includes a pair of cable retaining spring arm members 207, 208. As shown in FIG. 16, arm members 205, 206, 207, 208 are oriented at an angle of about 45° relative to respective sides. The arm members 205, 206, 207, 208 can be staggered at slightly different angles for gripping the spiraled surface of the armored sheath of electrical cable 14.

As depicted, arm members 205 and 206 are formed directly adjacent each other in a juxtaposed, spaced, cooperating relationship, while arm members 207 and 208 are also formed in a juxtaposed, spaced, cooperating relationship with each other. Furthermore, arm members 205 and 207 are diametrically opposed to each other, while arm members 206 and 208 are also diametrically opposed to each other.

As depicted, arm members 205, 206, 207, and 208 are preferably constructed with sloping intermediate sections and sloping end sections. In addition, if desired, the terminating end of each arm member may be constructed with an arcuate curve, for securely, lockingly engaging the outer surface of any cable member mounted therewith. Furthermore, the overall lengths of the arm members may be substantially equal or varied relative to each other, depending upon the configuration desired. Additional details of arm members 205, 206, 207 and 208 are disclosed in U.S. Pat. No. 6,872,886, and incorporated herein by reference.

The connector assembly 10 is especially useful for securing MC (metal clad) or armored cable to a panel or electrical box. MC or armored cables include a convoluted outer surface consisting of peaks and grooves such as shown in FIGS. 5 and 13.

Electrical cable 14 is coupled to connector assembly 10 by feeding wires through the axial passage of cable connector body 20 and through the axial passage of insulator 24. Cable 14 is passed through the axial passage so that arm members 205, 206, 207, 208 engage the outer surface of the armored sheath of electrical cable 14, as shown in FIGS. 5 and 13. Arm members 205, 206, 207, 208 are spring biased in a direction to engage the corrugations of the armored sheath and resist separation of cable 14 from cable connector 10.

Upon insertion, hook 80 engages an inner surface of electrical box 12 and tabs 82 engage an outer surface of electrical box 12. When the outlet end portion 28 is inserted into electrical box 12, the hook 80 is initially depressed (by pressing on spring clip 22) and then released to secure the connector assembly 10 to the electrical box. Cable retaining springs arm members 205, 206, 207, 208 engage cable 14, preferably within a cable groove, and provide a force tending to resist withdrawal of cable 14 from connector assembly 10. As shown in FIGS. 5 and 13, insulator 24 additionally functions as a cable stop to limit further introduction of cable 14 into electrical box 12, as an outer covering of cable 14 engages portions of insulator 24 around a central bore.

Embodiments of connector assemblies of the present invention are designed to secure MC (metal clad) or AC (armor clad) cables or ⅜" flexible metal conduit (FMC) to an electrical box or enclosure. The connectors may accept multiple versions of these cables, for example 14/2 or 10/3, which may vary in outer diameter from 0.420" to 0.600". The flexible nature of the spring clip 22 and internal guide ribs permit the connector assembly 10 to be utilized across a range of cable diameters. In other embodiments of the present invention, other cable types and sizes may be utilized.

Figure 22:
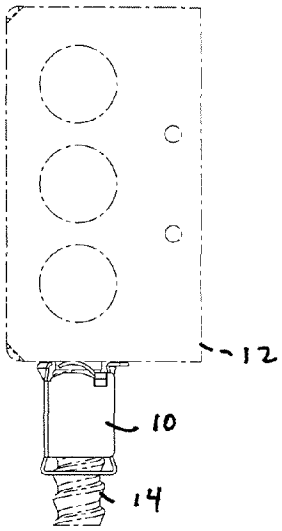
FIGS. 18-22 depict steps in the installation of the connector assembly of FIG. 1 into an electrical box.
Figure 20:
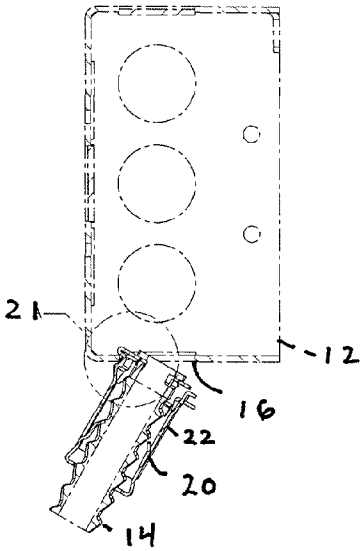
Figure 21:
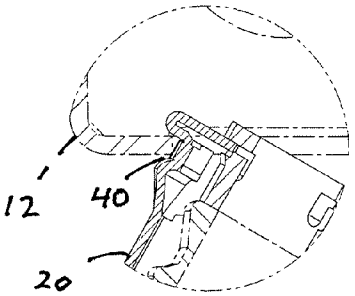
Figure 19:
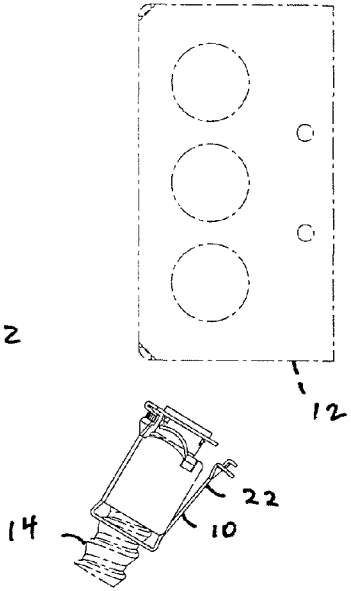
Figure 18:
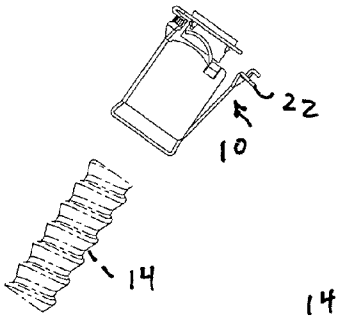

Referring to FIGS. 18-22, a method of using a connector assembly 10 can be described. FIG. 18 depicts an initial step of inserting the cable 14 into the connector assembly 10. Cable 14 is inserted into bore 30 until contact is made between insulator 24 and cable 14. One or more arm members 205, 206, 207, 208 make contact with the cable 14 as the cable is inserted. The arm members 205, 206, 207, 208 function to hold the connector body 20 on the cable 14. FIG. 19 depicts positioning the connector assembly 10 at an angle relative to electrical box 12 and knock-out hole 16. FIG. 20 depicts depressing spring clip 22, such as with an installer's thumb. Lug 40 is initially inserted to engage a lower edge portion of knock-out hole 16 and connector body 20 is then rotated generally about lug 40. FIG. 21 is a detailed view of FIG. 20 and shows lug 40 engaging the edge of the knock-out hole 16. During installation, spring clip 22 is deflected into the connector body 20 to allow hook 80 to pass into the interior of the electrical box 12. Upon insertion, as shown in FIG. 22, spring clip 22 is released and hook 80 engages inner surface of the electrical box 12 and tabs 82 engage outer surfaces of the electrical box 12.

Connector assembly 10 can be removed from the electrical box 12 in reverse manner by depressing the spring clip 22 to release the hook portion 80 from the knock-out hole 16 in electrical box 12 and pivoting connector assembly 10 downwardly. If necessary, cable 14 can be separated from the connector assembly 10 by lifting upwardly on spring clip 22 to release the arm members 205, 206, 207, 208 from contact with the electrical cable. Alternatively, cable 14 can be removed from the connector assembly 10 by simply twisting the connector body 20 relative to the cable in a counter-clockwise direction.

The present invention is also directed to a method of using a connector assembly 10, wherein the method includes inserting a lug 40 at an outlet end portion 28 of the connector assembly into the knock-out hole 16 with a free end of the spring clip 22 being deflected prior to contact with a side wall of the electrical box 12, then pivoting and further inserting the connector assembly 10 into the electrical box 12 to release the free end and lock the connector body 20 in place with a hook 80 and tab 82 structure. As the connector body 20 is pivoted during installation into the electrical box 12, the hook end of the spring clip 22 is initially depressed and then released after the hook 80 of the spring clip 22 enters the electrical box.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An electrical connector assembly for securing an electrical cable to an electrical box comprising:

a connector body having an inlet end portion and an outlet end portion and a bore there between;

an insulator retained at the outlet end portion of said connector body, with said connector body including a spring clip secured to said connector body at the inlet end portion and extending away from the inlet end portion toward the insulator, said spring clip including a hook for engaging an inner surface of the electrical box to retain the connector body to the electrical box, and with at least one arm member extending into the connector body for retaining the cable within the connector body; and a pair of cantilevered, curved springs each attached at one end to the connector body at the outlet end portion and each having a free end at the outlet end portion, with an outer surface of the electrical box directly engaging at least one of the pair of springs at a contact location between the one end and away from the free end, and with the free ends of the pair of cantilevered, curved springs being unsupported and not engaging against the connector body, and said pair of curved springs acting as stops to limit a degree to which the connector body is inserted into the electrical box.

2. The connector assembly of claim 1 wherein the insulator defines a cable stop for limiting further movement of the cable within the connector body.

3. The connector assembly of claim 1 wherein the insulator is received into the outlet end portion of the connector body.

4. The connector assembly of claim 1 wherein the spring clip includes a pair of tabs adapted to engage an outer surface of the electrical box.

5. The connector assembly of claim 1 wherein the spring clip includes a pair of arm members extending into the connector body for retaining the cable within the connector body.

6. An electrical connector assembly for securing an electrical conductor to an electrical box comprising:

a connector body having an inlet end portion and an outlet end portion and a bore there between;

a insulator received into the outlet end portion, with the connector body including a spring clip having a first free end extending away from the inlet end portion and spanning an open portion of the connector body, said spring clip including a hook for engaging an inner surface of the electrical box to retain the connector body to the electrical box, and said spring clip including a pair of inwardly directed arm members extending toward the outlet end portion of the connector body for retaining the electrical conductor within the connector body; and a pair of curved springs each attached at one end to the connector body at the outlet end portion and having a cantilevered free end at the outlet end portion, with an outer surface of the electrical box directly engaging at least one of the pair of springs at a contact location between the one end and away from the free end, and with the cantilevered free ends being otherwise unsupported and not directly engaging against the connector body, and said pair of curved springs acting as stops to limit a degree to which the connector body is inserted into the electrical box.

7. The connector assembly of claim 6 wherein the spring clip further comprises a pair of tabs adapted to engage an outer surface of the electrical box.

8. The connector assembly of claim 6 further comprising a pair of arm members on a side of the connector body opposite the spring clip.

9. An electrical connector assembly for securing an electrical conductor to an electrical box comprising:

a connector body having an inlet end portion and an outlet end portion and a bore therebetween; and a insulator received into the outlet end portion, with the connector body including a spring clip having a first free end extending away from the inlet end portion and spanning an open portion of the connector body, said spring clip including a hook for engaging an inner surface of the electrical box to retain the connector body to the electrical box, said spring clip including a pair of inwardly directed arm members extending toward the outlet end portion of the connector body for retaining the electrical conductor within the connector body, and with the connector body having a pair of curved, cantilevered springs attached near the outlet end portion of the connector body, said pair of springs adapted to directly engage an outer surface of the electrical box at a contact location away from free ends of the pair of springs and limit a degree to which the connector body is inserted into the electrical box, and wherein the free ends of the pair of springs are otherwise unsupported and not directly engaged against the connector body.

10. The connector assembly of claim 9 wherein the spring clip further comprises a pair of tabs adapted to engage the outer surface of the electrical box.

11. The connector assembly of claim 10 wherein the hook is positioned between the pair of tabs.

12. The connector assembly of claim 9 further comprising a pair of arm members on a side of the connector body opposite the spring clip.

13. An electrical connector assembly for securing an electrical conductor to an electrical box comprising:

a connector body having an inlet end portion and an outlet end portion and a bore therebetween, with the connector body including a spring clip having a first free end extending away from the inlet end portion and spanning an open portion of the connector body, said spring clip including a hook for engaging an inner surface of the electrical box to retain the connector body to the electrical box, said spring clip including at least one arm member extending toward the outlet end portion of the connector body for retaining the electrical conductor within the connector body, and said connector body having a pair of flat sides and having a pair of curved, cantilevered springs attached at the outlet end portion and extending from a pair of edges of the pair of flat sides near the outlet end portion of the connector body, said pair of springs adapted to directly engage an outer surface of the electrical box at a contact location away from free ends of the pair of springs and limit a degree to which the connector body is inserted into the electrical box, and with the free ends of the pair of springs being otherwise unsupported and not directly engaged against the connector body.

14. The connector assembly of claim 13 further comprising an insulator held at the outlet end portion.

15. The connector assembly of claim 13 further comprising at least one arm member positioned on a side of the connector body opposite the spring clip for retaining the electrical conductor within the connector body.

16. A method of securing a cable to an electrical box using a connector assembly comprising:

providing a connector assembly having a connector body, an insulator received into the connector body, and a spring clip, said spring clip having a free end and extending across an open portion of the connector body and, said spring clip further including a hook and a pair of tabs at its free end, and a pair of curved, cantilevered springs;

inserting an outlet end portion of the connector assembly into a knock-out hole of the electrical box until a perimeter edge of the knock-out hole engages a lug;

further inserting the outlet end portion into the knock-out hole while depressing the free end of the spring clip to allow the hook to enter the electrical box;

yet further inserting the outlet end portion into the knock-out hole until the pair of curved, cantilevered springs directly engage an outer surface of the electrical box at a contact location away from free ends of the pair of springs, and with the free ends of the pair of springs being otherwise unsupported and not directly engaging against the connector body; and releasing the spring clip to allow the hook of the spring clip to engage an inner surface of the electrical box and the pair of tabs to engage the outer surface of the electrical box.

17. The method of claim 16 further comprising: securing the cable within the connector body with a plurality of arm members.

18. The method of claim 16 wherein said spring clip includes a pair of arm members, and said depressing the free end causes the pair of arm members to deflect in engagement with the cable.

* * * * *